US008466392B2

(12) United States Patent
O'Connor

(10) Patent No.: US 8,466,392 B2
(45) Date of Patent: Jun. 18, 2013

(54) MATERIAL AND HEATING CABLE

(75) Inventor: Jason Daniel Harold O'Connor, Derbyshire (GB)

(73) Assignee: Heat Trace Limited, Frodsham (GB)

( * ) Notice: Subject to any disclaimer, the term of this patent is extended or adjusted under 35 U.S.C. 154(b) by 1231 days.

(21) Appl. No.: 12/301,014

(22) PCT Filed: May 17, 2007

(86) PCT No.: PCT/GB2007/001850

§ 371 (c)(1),
(2), (4) Date: Nov. 14, 2008

(87) PCT Pub. No.: WO2007/132256

PCT Pub. Date: Nov. 22, 2007

(65) Prior Publication Data

US 2009/0184108 A1 Jul. 23, 2009

(30) Foreign Application Priority Data

May 17, 2006 (GB) ..... 0609729.9
Mar. 21, 2007 (GB) ..... 0705334.1

(51) Int. Cl.
*H05B 3/10* (2006.01)
*H05B 3/34* (2006.01)

(52) U.S. Cl.
USPC ..... 219/548; 219/549; 219/552; 219/553; 219/537; 219/538; 219/544; 219/546

(58) Field of Classification Search
USPC ..... 219/548, 549, 552, 553, 537, 538, 219/544, 546
See application file for complete search history.

(56) References Cited

U.S. PATENT DOCUMENTS

| | | | |
|---|---|---|---|
| 4,314,145 | A | 2/1982 | Horsma |
| 4,330,703 | A | 5/1982 | Horsma et al. |
| 4,659,913 | A | 4/1987 | Midgley et al. |
| 5,057,674 | A | 10/1991 | Smith-Johannsen |
| 6,303,866 | B1 | 10/2001 | Lagreve et al. |
| 2005/0062582 | A1 | 3/2005 | Feichtinger et al. |

FOREIGN PATENT DOCUMENTS

| | | | |
|---|---|---|---|
| CA | 2652012 | A1 | 11/2007 |
| CN | 1320352 | A | 10/2001 |
| CN | 2630692 | Y | 8/2004 |
| CN | 101485230 | A | 7/2009 |
| EP | 2018791 | B1 | 3/2010 |
| GB | 2 075 992 | A | 11/1981 |

(Continued)

OTHER PUBLICATIONS

International Search Report for International Application No. PCT/GB2007/001850; date of mailing Sep. 12, 2007; 5 pages.

(Continued)

*Primary Examiner* — Shawntina Fuqua
(74) *Attorney, Agent, or Firm* — Foley & Lardner LLP

(57) ABSTRACT

A material comprises: a first component having a first positive temperature coefficient of resistance characteristic; and a second component having a second positive temperature coefficient of resistance characteristic, the second positive temperature coefficient of resistance characteristic being different from the first positive temperature coefficient of resistance characteristic, the proportions of the two components being such that the material has a positive temperature coefficient of resistance characteristic which is a combination of the first and second positive temperature coefficient of resistance characteristics of the first and second components.

19 Claims, 3 Drawing Sheets

FOREIGN PATENT DOCUMENTS

| | | | | |
|---|---|---|---|---|
| GB | 2307385 | A | | 5/1997 |
| JP | 08-306508 | | | 11/1996 |
| JP | 11282548 | | | 10/1999 |
| JP | 11282548 | A | | 10/1999 |
| JP | 2004079558 | A | | 3/2004 |
| RU | 2216882 | | | 6/2003 |
| RU | 2402182 | | | 6/2010 |
| WO | WO 2004/010736 | A1 | | 1/2004 |
| WO | 2006/067485 | | * | 6/2006 |
| WO | WO 2006/067485 | A1 | | 6/2006 |

OTHER PUBLICATIONS

Search Report for Application No. GB0609729.9, dated Nov. 16, 2006, 3 pages.

Search Report for Application No. GB0609729.9, dated Feb. 20, 2007, 2 pages.

Search Report for Application No. GB0705334.1, dated Apr. 12, 2007, 4 pages.

International Search Report and Written Opinion for International Application No. PCT/GB2007/001850, mail date Sep. 12, 2007, 16 pages.

Decision on Grant of a Patent for Invention filed in Russian Application No. 2008149695/09(065192) dated Apr. 29, 2010, 8 pages.

Translation in English of Decision on Grant of Patent for Invention filed in Russian Application No. 2008149695/09(065192) dated Apr. 29, 2010, 5 pages.

First Office Action filed in Chinese Application No. 2007800179607 dated Aug. 8, 2011, 3 pages.

Translation in English of First Office Action filed in Chinese Application No. 2007800179607 dated Aug. 8, 2011, 5 pages.

* cited by examiner

MATERIAL AND HEATING CABLE

CROSS-REFERENCE TO RELATED PATENT APPLICATIONS

The present application is a U.S. National Stage filing under 35 U.S.C. §371 of PCT Pat. App. No. PCT/GB2007/001850 filed May 17, 2007, published in English and designating the United States, and claims priority under 35 U.S.C. §119 to British Patent Application No. 0609729.9, filed May 17, 2006 and British Patent Application No. 0705334.1, filed Mar. 21, 2007.

BACKGROUND

The present application relates to a material, and to a heating cable which includes the material.

Heating cables are well known, and are used for example to heat pipes in chemical processing plants. Typically, a heating cable is attached along the exterior of a pipe which is exposed to the components. Often, the heating cable is attached to a thermostat, and is activated by the thermostat when the temperature falls below a predetermined level. The heating cable acts to warm the pipe, thereby ensuring that the temperature of the pipe remains sufficiently high that the contents of the pipe do not become frozen or undergo other unwanted temperature related effects.

In recent years, heating cables have been manufactured which include a material having a positive temperature coefficient of resistance. This has the advantage that the heating cable is self regulating (when a constant voltage is applied across the heating cable). The current supplied to the heating cable will reduce as its temperature increases, thereby preventing the heating cable reaching an unwanted excessively high temperature. A problem associated with heating cables of this type is that they have a very low resistance when at low temperatures. This can cause an unwanted surge of current to pass through the heating cable when, for example, a power supply connected to the heating cable is turned on. Various mechanisms have been suggested to solve this problem.

SUMMARY

According to a first embodiment, there is provided a material which comprises: a first component having a first positive temperature coefficient of resistance characteristic; and a second component having a second positive temperature coefficient of resistance characteristic, the second positive temperature coefficient of resistance characteristic being different from the first positive temperature coefficient of resistance characteristic, the proportions of the two components being such that the material has a positive temperature coefficient of resistance characteristic which is a combination of the first and second positive temperature coefficient of resistance characteristics of the first and second components.

The material may comprise a third component having a first negative temperature coefficient of resistance characteristic. The material may further comprise a fourth component having a second negative temperature coefficient of resistance characteristic, the second negative temperature coefficient of resistance characteristic being different from the first negative temperature coefficient of resistance characteristic.

According to a second embodiment, there is provided a material which comprises: a first component having a first negative temperature coefficient of resistance characteristic; and a second component having a second negative temperature coefficient of resistance characteristic, the second negative temperature coefficient of resistance characteristic being different from the first negative temperature coefficient of resistance characteristic, the proportions of the two components being such that the material has a negative temperature coefficient of resistance characteristic which is a combination of the first and second negative temperature coefficient of resistance characteristics of the first and second components.

The material may comprise a third component having a first positive temperature coefficient of resistance characteristic. The material may further comprise a fourth component having a second positive temperature coefficient of resistance characteristic, the second positive temperature coefficient of resistance characteristic being different from the first positive temperature coefficient of resistance characteristic.

According to a third embodiment, there is provided a heating cable comprising one or more conductors embedded in a material according to the first and/or second embodiments.

According to a fourth embodiment, there is provided a method of making a material, the method comprising: mixing a first component having a first positive temperature coefficient of resistance characteristic into a matrix; and mixing a second component having a second positive temperature coefficient of resistance characteristic into the matrix, the second positive temperature coefficient of resistance characteristic being different from the first positive temperature coefficient of resistance characteristic, the proportions of the two components being selected such that the material has a positive temperature coefficient of resistance characteristic which is a combination of the first and second positive temperature coefficient of resistance characteristics of the first and second components.

Preferably the matrix is a polymer.

According to a fifth embodiment, there is provided a method of making a material, the method comprising: mixing a first component having a first negative temperature coefficient of resistance characteristic into a matrix; and mixing a second component having a second negative temperature coefficient of resistance characteristic into the matrix, the second negative temperature coefficient of resistance characteristic being different from the first negative temperature coefficient of resistance characteristic, the proportions of the two components being selected such that the material has a negative temperature coefficient of resistance characteristic which is a combination of the first and second negative temperature coefficient of resistance characteristics of the first and second components.

Preferably the matrix is a polymer.

According to a sixth embodiment, there is provided a heating cable comprising a first conductor which is surrounded by extruded negative temperature coefficient of resistance material, and a second conductor, the first and second conductors being embedded within an extruded positive temperature coefficient of resistance material.

Preferably, the component having the negative temperature coefficient of resistance comprises a ceramic. Preferably, the ceramic comprises a mixture of $Mn_2O_3$ and NiO. Preferably, the ceramic comprises 82% of $Mn_2O_3$ and 18% of NiO. Preferably, the mixture is calcinated. Preferably, the calcination takes place at a temperature of at least 900° C.

According to a seventh embodiment, there is provided a heating cable comprising a first conductor which is surrounded by extruded positive temperature coefficient of resistance material, and a second conductor, the first and second conductors being embedded within an extruded negative temperature coefficient of resistance material.

Preferably, the component having the negative temperature coefficient of resistance comprises a ceramic. Preferably, the ceramic comprises a mixture of $Mn_2O_3$ and NiO. Preferably, the ceramic comprises 82% of $Mn_2O_3$ and 18% of NiO. Preferably, the mixture is calcinated. Preferably, the calcination takes place at a temperature of at least 900° C.

BRIEF DESCRIPTION OF THE DRAWINGS

Embodiments will now be described, by way of example only, with reference to the accompanying figures, in which.

DETAILED DESCRIPTION OF EXEMPLARY EMBODIMENTS

Figure 1:
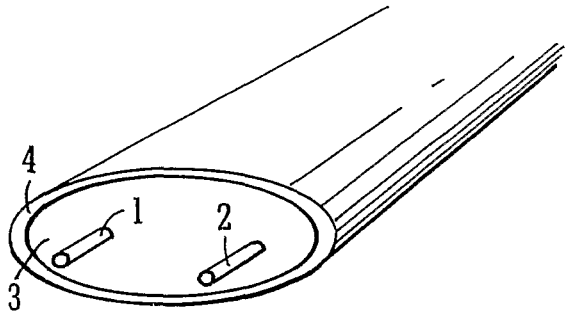
FIG. 1 is a schematic representation of a heating cable according to an exemplary embodiment.

FIG. 1 shows a heating cable comprising a pair of conductors 1, 2 embedded in a material 3. The material 3 is surrounded by an insulative material 4.

The material 3 comprises a mixture of components, and includes one or more components that provide a positive temperature coefficient of resistance and one or more components that provide a negative temperature coefficient of resistance. The components are embedded in a polymer, for example polyethylene. The relative proportions of the components are selected such that the heating cable has a desired variation of resistance with respect to temperature, for example as shown in FIG. 2.

Figure 2:
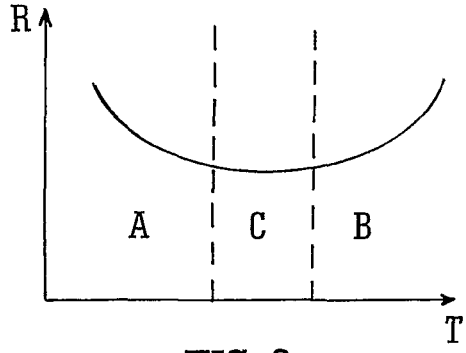
FIG. 2 is a graph which schematically illustrates the operation of the embodiment.

Referring to FIG. 2, at low temperatures the material has a negative temperature coefficient of resistance. This is indicated as region A. At high temperatures the material 3 has a positive temperature coefficient of resistance. This region is indicated as region B. Between these two regions is a central region within which the temperature coefficient of resistance is relatively flat. This will be referred to as the equilibrium temperature coefficient region, and is indicated as region C.

The material performance illustrated in FIG. 2 is particularly useful because it allows a fully self-regulating heating cable to be made. Generally, a heating cable will be at a low temperature when it is switched on. A constant voltage power supply is connected to the heating cable, and it is preferable that the cable has a high resistance at low temperatures, so that a surge of current does not occur when the heating cable is switched on. The negative temperature coefficient of resistance performance of the material at low temperatures (i.e. operation in region A of FIG. 2) achieves this, by ensuring that the resistance of the heating cable is high at low temperatures.

As the temperature of the heating cable increases, its resistance decreases. This causes more current to flow through the heating cable, thereby further increasing the temperature of the heating cable. This continues until the negative temperature coefficient of resistance of the material begins to be balanced by the positive temperature coefficient of resistance of the material. The negative temperature coefficient of resistance of the material gradually reduces (the gradient of the curve in FIG. 2 reduces), until it reaches zero. In other words, the material enters the equilibrium temperature coefficient region (i.e. region C of FIG. 2). Within the equilibrium temperature coefficient region, the resistance of the heating cable is only marginally affected by small changes of the temperature of the heating cable.

The temperature of the heating cable will settle in the equilibrium temperature coefficient region C. In particular, the temperature of the heating cable will settle at that temperature at which the negative temperature coefficient of resistance and the positive temperature coefficient of resistance of the material cancel each other out (i.e. the gradient of the curve in FIG. 2 is zero). If the current supplied to the heating cable were to increase significantly, then this would increase the temperature of the heating cable. The positive temperature coefficient of resistance of the material would then increase, and outweigh the negative temperature coefficient of resistance of the material. The heating cable would therefore enter the positive temperature coefficient region (i.e. region B of FIG. 2), the resistance of the heating cable would increase, and the current supplied to the heating cable would therefore be reduced. The heating cable would thus return to the equilibrium temperature coefficient region. Similarly, if the current supplied to the heating cable were to decrease significantly, then the heating cable would enter the negative temperature coefficient region (i.e. region A of FIG. 2). The resistance of the heating cable would increase, causing the supplied current to be reduced as the temperature decreases.

The size of the equilibrium temperature coefficient region is difficult to define. For example referring to FIG. 2, the curve at the edges of the equilibrium temperature coefficient region C can be seen to have a small gradient (i.e. a non-zero temperature coefficient of resistance). The curve in FIG. 2 may be considered to have only one temperature at which the gradient of the curve is zero. This is referred to hereafter as the equilibrium temperature. A region which extends either side of the equilibrium temperature, within which the resistance of the heating cable is only marginally affected by small changes of the temperature of the heating cable, is the equilibrium temperature coefficient region. It will be appreciated that the size of this region will depend upon the shape of the temperature coefficient curve. This will depend upon the amounts and the types of NTC and PTC components that are used, as described further below.

The material 3 used in the heating cable comprises (in terms of percentage of weight) the components shown in Table 1:

| | Ingredient | | | | | |
|---|---|---|---|---|---|---|
| | Resin (Polyethylene) | C/Black | Zinc Oxide | Thermo Stabiliser | NTC Ceramic | Total |
| Content (wt %) | 13.36 | 4.94 | 1.54 | 0.15 | 80.00 | 100.00 |

The polyethylene grades are DFDA7540 and DGDK3364, available from Union Carbide Corporation (UCC), USA. To make the material, the polyethylene is mixed with the carbon black, the zinc oxide and the thermo-stabiliser. The carbon black provides a positive temperature coefficient of resistance. The zinc oxide is used to absorb acid which may be released in the heating cable during use, and which may otherwise damage the cable. The thermo-stabiliser acts to prevent decomposition of the heating cable. An example of a suitable thermo-stabiliser is Irganox 1010, available for example from Ciba Specialty Chemicals of Basel, Switzerland.

The NTC ceramic, which is in powder form, is separately prepared. It comprises a mixture of 82% of $Mn_2O_3$ and 18% of NiO by weight. The mixture, which is a coarse powder, is mixed with purified water using a ball mill and is then dried. The mixture is then calcinated at between 900 and 1200° C. A binder is then added to the mixture, which is then mixed by ball mill, filtered and dried. The mixture is then press-moulded into a disk shape, and fired at between 1200 and 1600° C. The disk is then crushed into a powder having a particle size of between 20 and 40 μm. This powder is the NTC ceramic, which is to be added to the polyethylene mixture (i.e. polyethylene mixed with carbon black, zinc oxide and thermo-stabiliser).

The polyethylene mixture, of which there is 70 grams, is loaded into a roll-mill having two 6 inch rollers. The rollers of the roll mill are heated to a temperature of 160° C. prior to receiving the polyethylene mixture. The NTC ceramic is added to the polyethylene mixture in lots of between 20 and 50 grams until 280 grams has been added to the mixture. The resulting material has the properties shown in FIG. 3.

It will be appreciated that the NTC ceramic may be added to the polyethylene mixture by any of several plastic processing techniques which will be known to those skilled in the art, using for example a single or twin extruder, a roll-mill or heavy duty kneader.

Figure 3:
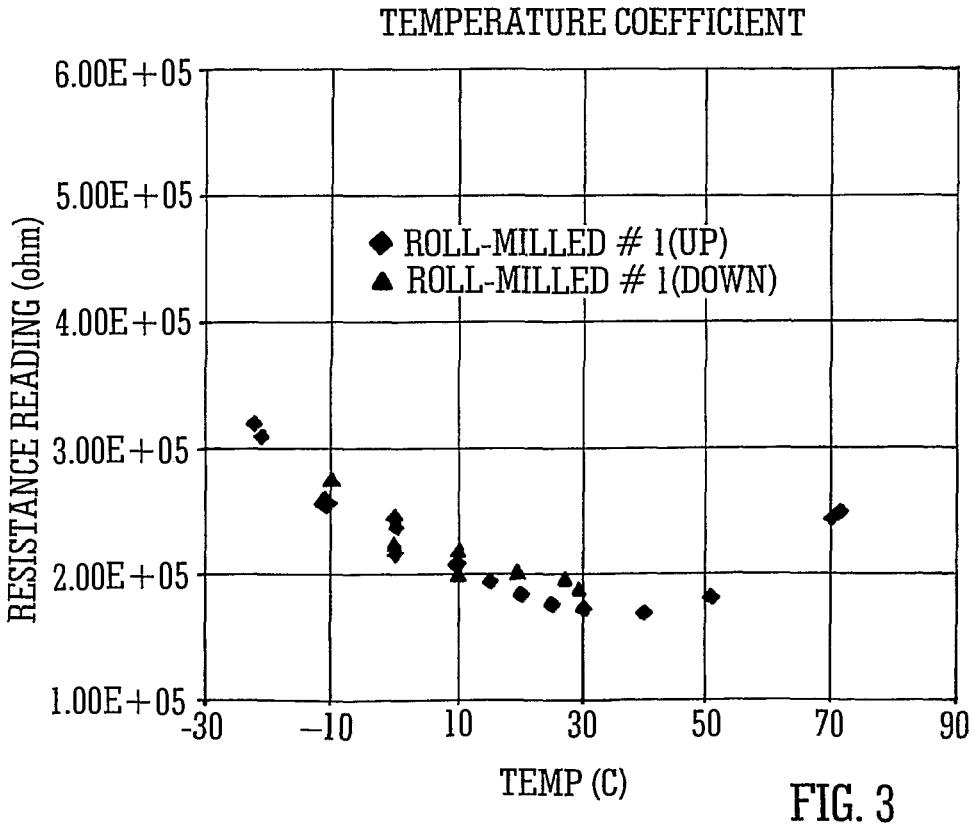
FIG. 3 is a graph showing the properties of a specific heating cable according to an exemplary embodiment.

Referring to FIG. 3, it can be seen that a sample has a temperature coefficient which is negative at low temperatures, i.e. up to around 30° C. The temperature coefficient then passes through an equilibrium region, around roughly 40° C. The temperature coefficient then becomes positive at higher temperatures, i.e. roughly 50° C. and higher. Thus, the material may be used to form a heating cable which is self-regulating at a temperature of around 40° C. The two sets of data shown are for the same sample, the first showing the resistance of the sample as it was heated, and the second showing the resistance of the sample as it was cooled down.

The proportions of NTC ceramic and carbon black used in the material are selected such that the material has a negative temperature coefficient of resistance at low temperatures, a positive temperature coefficient of resistance at high temperatures, and an equilibrium temperature coefficient at the temperature at which it is desired to operate the heating cable.

The carbon black and the polyethylene provide the positive temperature coefficient of resistance. This is because the polyethylene expands when its temperature increases, increasing the distance between adjacent carbon black particles and thereby causing an increase of resistivity. This effect is stronger than the negative temperature coefficient of resistance effect provided by the NTC ceramic, and it is for this reason that roughly 16 times more NTC ceramic is used than carbon black.

The strength of the positive temperature coefficient of resistance provided by the carbon black is believed to be reduced by processing the material with the roll-mill. It is believed that this is because using the roll-mill changes the carbon black from a crystalline form to amorphous carbon. The crystalline carbon black provides current paths through the material (i.e. current passes between carbon black crystals, and thereby passes through the material). As the amount of crystalline carbon black is reduced (though conversion to amorphous carbon), the strength of the positive temperature coefficient of resistance effect provided by the carbon black is reduced.

Reducing the strength of the positive temperature coefficient of resistance in this way allows it to be balanced against the negative temperature coefficient of resistance provided by the NTC ceramic.

The heating cable shown in FIG. 1 is fabricated by passing the two conductors 1, 2 through openings in a die (not shown), and extruding the material 3 through the die such that it forms a cable within which the conductors are embedded. Construction of a heating cable in this manner is well known to those skilled in the art, and so is not described here in further detail.

The properties of the heating cable may be selected by adjusting the proportions of negative temperature coefficient of resistance material (e.g. NTC ceramic) and positive temperature coefficient of resistance material (e.g. carbon black) used in the heating cable. In addition, a different NTC ceramic may be used.

Each NTC ceramic has its own Curie Temperature Point (hereafter referred to as Tc), where the resistance of the NTC ceramic changes sharply. By selecting a different NTC ceramic having a different Tc, a particular desired negative temperature coefficient of resistance effect can be obtained. More than one NTC ceramic may be used, the NTC ceramics having different Tc's, thereby allowing shaping of the negative temperature coefficient of resistance curve.

Figure 4:
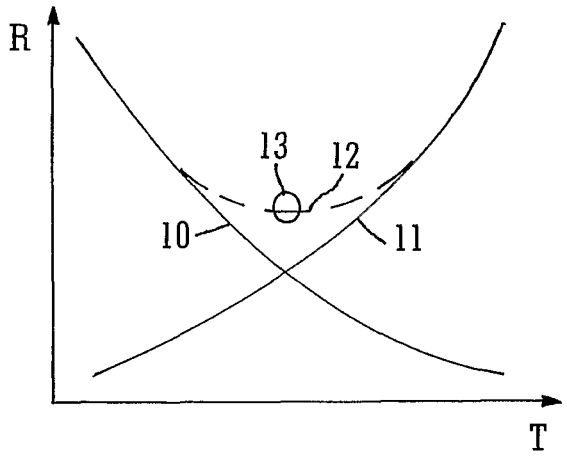
FIG. 4 is a graph which schematically illustrates the effect of modifying the composition of the heating cable.

The separate effects of the negative temperature coefficient of resistance material and the positive temperature coefficient of resistance material are shown schematically in FIG. 4. The effect of the negative temperature coefficient of resistance material is shown by line 10, and the effect of the positive temperature coefficient of resistance material is shown by line 11. The combined effects of these materials is shown by the dotted line 12. The dotted line 12 includes an equilibrium point 13 (the equilibrium temperature) at which the effect of the negative temperature coefficient of resistance material is equal to the effect of the positive temperature coefficient of resistance material.

Increasing the proportion of negative temperature coefficient of resistance material will shift line 10 upwards, thereby shifting the equilibrium point 13 upwards and to the right. In other words, the equilibrium temperature will be greater and will occur at a higher resistance. Reducing the proportion of negative temperature coefficient of resistance material will shift the line 10 downwards, and move the equilibrium point 13 downwards and to the left. In other words, the equilibrium temperature will be lower and will occur at lower resistance.

Similarly, increasing the proportion of positive temperature coefficient of resistance material will shift line 11 upwards, thereby shifting the equilibrium point 13 upwards and to the left. In other words, the equilibrium temperature will be lower and will occur at a higher resistance. Reducing the proportion of positive temperature coefficient of resistance material will shift the line 11 downwards, and move the equilibrium point 13 downwards and to the right. In other words, the equilibrium temperature will be higher and will occur at a lower resistance.

In order to adjust the gradient of the negative temperature coefficient of resistance line 10, a material with a different negative temperature coefficient of resistance may be used. For example, if an NTC ceramic is selected which has a lower Tc, the equilibrium temperature will be lower (assuming that the line 11 is unchanged). Similarly, if an NTC ceramic is selected which has a higher Tc, the equilibrium temperature will be higher (assuming that the line 11 is unchanged). The shape of the negative temperature coefficient of resistance line 10 may be modified by mixing together two or more NTC ceramics having different Tc's. In other words, according to an embodiment, two or more components having different negative temperature coefficient of resistance characteristics can be mixed together to form a material (which may include one or more PTC materials). The material will then exhibit a negative temperature coefficient of resistance characteristic (at least over a particular temperature range) which is a combination of the first and second negative temperature coefficient of resistance characteristics of the first and second components.

The gradient of the positive temperature coefficient of resistance line 11 may be adjusted by using a different positive temperature coefficient of resistance component. For example, any other suitable conductive particles such as metal powder, carbon fibre, carbon nanotube or PTC ceramic. The shape of the positive temperature coefficient of resistance line 11 may be modified by mixing together two or more positive temperature coefficient of resistance components. In other words, according to an embodiment, two or more components having different positive temperature coefficient of resistance characteristics can be mixed together to form a material (which may include one or more NTC materials). The material will then exhibit a positive temperature coefficient of resistance characteristic (at least over a particular temperature range) which is a combination of the first and second positive temperature coefficient of resistance characteristics of the first and second components.

In the example material described above, the material with a positive temperature coefficient of resistance is carbon black. The positive temperature coefficient of resistance line 11 may be shifted upwards by hot-pressing the material (without increasing the proportion of carbon black). It is believed that this occurs because the hot-pressing increases the volume of the crystalline proportion of the carbon black (the amorphous proportion is reduced), so that the strength of the positive temperature coefficient of resistance effect is increased. Hot pressing comprises putting the material underneath a heated piston which is used to apply pressure to the material. The pressure applied and the temperature of the piston head are adjustable. The amount of heat and pressure applied to the material (together with the time period over which pressure is applied) may be adjusted to obtain a particular desired temperature coefficient or resistance, for example by experimenting with samples of the material.

Figure 5:
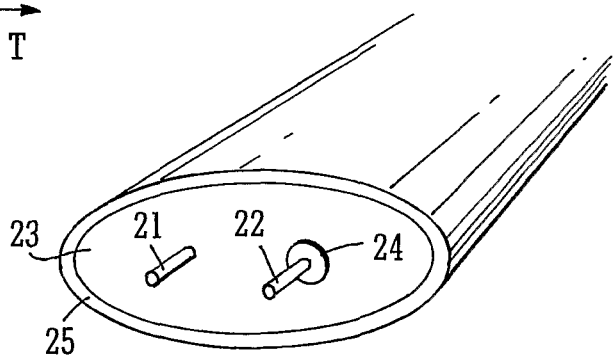
FIG. 5 is a schematic representation of an alternative heating cable according to an exemplary embodiment.

It will be appreciated that the material may be used to make heating cables having forms other than that illustrated in FIG. 1. For example, a heating cable may be constructed which is formed from the material surrounded by a protective layer, either end of the material of the cable being connected to a power supply. This form of heating cable may be referred to as a series resistance heating cable The above described embodiment relates to a material which has a positive temperature coefficient of resistance and a negative temperature coefficient of resistance. However, a heating cable may be provided which is formed from a first material which has a positive temperature coefficient of resistance and a second material which has a negative temperature coefficient of resistance, as shown in FIG. 5. Referring to FIG. 5, a first conductor 21 and a second conductor 22 are embedded in a material 23 which has a positive temperature coefficient of resistance. The second conductor 22 is surrounded with a material 24 which has a negative temperature coefficient of resistance. An insulative material 25 surrounds the positive temperature coefficient material 23.

The heating cable of FIG. 5 is constructed by extruding the negative temperature coefficient material 24 through a die (not shown) through which the second conductor 22 passes. A suitable negative temperature coefficient material may be formed by adding the NTC ceramic referred to above to a polyethylene mixture which includes the material referred to above but does not include carbon black. Following this first extrusion, the positive temperature coefficient material 23 is extruded through a die (not shown) through which the first conductor 21 and second conductor 22 pass (the second conductor is already surrounded by negative temperature coefficient material 24). A suitable PTC material is the polyethylene mixture referred to above (without NTC powder).

In a further alternative arrangement (not shown), a heating cable may be constructed in which the first conductor and second conductor are embedded in a material which has a negative temperature coefficient of resistance. The second conductor may be surrounded with a material which has a positive temperature coefficient of resistance. Construction of this cable may also be via extrusion, in the same manner as described above.

In both of the above mentioned arrangements, the resulting temperature coefficient curve may be arranged to have a temperature coefficient of resistance curve of the type shown in FIG. 2. The gradient, width and position of the curve may be adjusted in the manner described above in relation to FIG. 4. Furthermore, the general shape of the curve may be modified, for example by adding a different PTC material or NTC material to the mixture.

Figure 6:
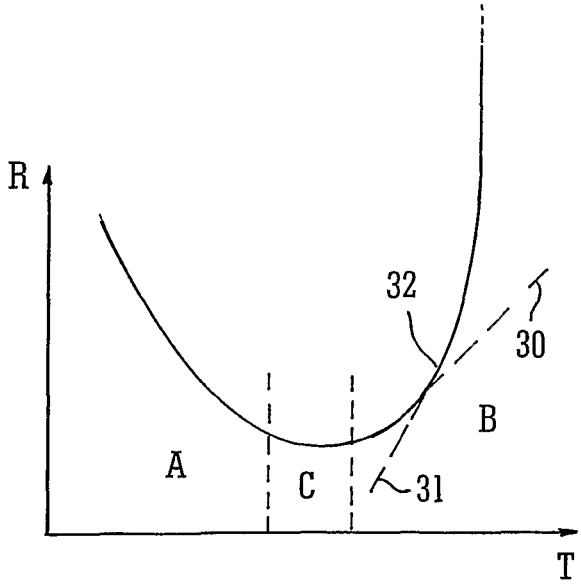
FIG. 6 is a graph showing the resistance of a material which includes one NTC component and two PTC components.

FIG. 6 shows schematically the variation of resistance with respect to temperature of a material according to an exemplary embodiment. The material includes a component which provides a negative temperature coefficient of resistance and two components which provide different positive temperature coefficients of resistance. At low temperatures, the material has a negative temperature coefficient of resistance, which is indicated as region A. At intermediate temperatures, the temperature coefficient of resistance is relatively flat, and this is labelled as region C. Beyond region C, the resistance increases gradually, and then increases more rapidly, before returning once again to a gradual increase. This positive temperature coefficient of resistance region is labelled as region B.

The negative temperature coefficient of resistance seen in region A of FIG. 6 may for example be provided by a component such as a ceramic, which is included in the material. An example of a ceramic which may be used to provide a negative temperature coefficient of resistance is described further above.

The steep and gradual parts of the curve in region B may be provided by two different components in the material, each of which has a different positive temperature coefficient of resistance. The first of these components may for example comprise carbon black (held in polyethylene, which forms a matrix in which the carbon black and other components are held). This component provides a positive temperature coefficient of resistance which is labelled as dotted line 30 in FIG. 6, i.e. a gradually increasing resistance. The second component may for example comprise a ceramic-metal composite, where the electrically conducting particles are selected from bismuth, gallium, or alloys thereof, and where the high electrical resistance material is selected from a ceramic oxide, such as alumina or silica, magnesia and mullite. (Ceramic nitrides, borate glasses, silicate glasses, phosphate glasses and aluminate glasses are other examples of suitable high electrical resistance materials.) This provides a greater positive temperature coefficient of resistance, which is labelled as dotted line 31 in FIG. 6, i.e. a more steeply increasing resistance.

Together the NTC component and two PTC components provide the material with a temperature coefficient of resistance (i.e. a temperature coefficient of resistance characteristic) which varies according to the curve 32 (i.e. the solid line) shown in FIG. 6. It will be appreciated that the curve 32 is intended to be a schematic illustration only, showing schematically the result of adding different PTC components together.

A heating cable constructed using a material having the coefficient of resistance characteristic shown in FIG. 6 has useful features. It will not suffer from a high in-rush current when it is cold, since it has an increased resistance at low temperatures. When the heating cable is at a temperature which is in the equilibrium temperature coefficient region C, the resistance of the cable, and hence the current supply to it will vary only slightly. When the cable becomes hotter, and passes into region B, it will at first gradually increase in resistance. However, as the cable gets hotter, the resistance of the cable will increase very rapidly, thereby dramatically reducing the amount of current which passes through the cable.

The cable effectively provides an automatic shut-off (i.e. such that there is no appreciable electrical current (or power) conducted by the cable), which prevents it from overheating. The automatic shut-off arises due to the greater positive temperature coefficient (i.e. the more steeply increasing resistance). As the temperature of the cable increases, the resistance of the cable increases more quickly and the amount of current delivered to the cable reduces quickly. In other words, conductive pathways within the positive temperature coefficient component of the cable diminish, and the cable becomes exponentially more resistive to current flow. This rapid reduction of the current delivered to the cable prevents it from overheating. In this way, the rapidly increasing resistance effectively makes it impossible for the cable to overheat to the extent that it will for example melt or catch fire.

The position of the rapidly increasing curve 31, i.e. the temperature at which its effect begins to be seen, may be selected via the choice of the second PTC component. This will affect the temperature at which automatic shut-off occurs.

Although FIG. 6 illustrates the resistance of a material which includes one NTC component and two PTC components, other combinations of NTC and PTC components may be used. For example, two NTC components may be used to provide a negative temperature coefficient of resistance curve which includes a region with a first gradient and a region with a second gradient. In another example two NTC components and two PTC components may be used. In general, any number of components may be used in order to obtain a desired variation of resistance with respect to temperature.

Figure 7:
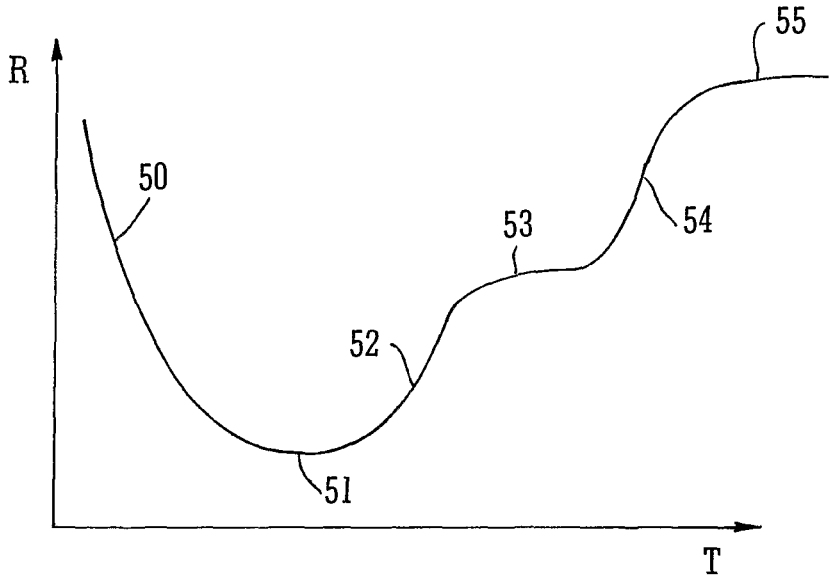
FIG. 7 is a graph showing the resistance of another material which includes one NTC component and two PTC components.

By using appropriate combinations of PTC and NTC components in a material, the resultant temperature characteristic can be made to have any desired shape. FIG. 7 is a graph of resistance versus temperature for a material having one NTC component and two PTC components. At all points along the characteristic, a balance is being struck in the material between the negative temperature coefficient of resistance of the NTC component and the positive temperature coefficients of resistance of the two PTC components. It can be seen that at a first part 50 of the characteristic, the negative temperature coefficient of resistance of the NTC component is dominant, meaning that the first part 50 of the characteristic exhibits a negative temperature coefficient of resistance. At a second part 51 of the characteristic, the negative temperature coefficient of resistance of the NTC component balances the positive temperature coefficient of resistance of the first PTC component, meaning that the second part 51 of the characteristic exhibits a zero temperature coefficient of resistance. At a third part 52 of the characteristic, the positive temperature coefficient of resistance of the first PTC component dominates the negative temperature coefficient of resistance of the NTC component, meaning that the third part 52 of the characteristic exhibits a positive temperature coefficient of resistance. At a fourth part 53 of the characteristic, the temperature is such that the influence of the first PTC component becomes negligible, meaning that the fourth part 53 of the characteristic exhibits an almost zero temperature coefficient of resistance. At a fifth part 54 of the characteristic, the temperature is such that the second PTC component becomes dominant, meaning that the fifth part 54 of the characteristic exhibits a positive temperature coefficient of resistance. Finally, at a sixth part 55 of the characteristic, the temperature is such that the influence of the second PTC component becomes negligible, meaning that the sixth part 55 of the characteristic exhibits an almost zero temperature coefficient of resistance.

Figure 8:
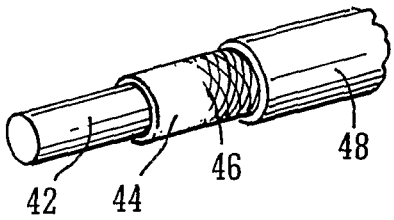
FIG. 8 is a schematic representation of another heating cable according to an exemplary embodiment.

The heating cable may be of the form shown in FIG. 1, i.e. comprising a pair of conductors 1,2 embedded in material 3 which includes the NTC and PTC components (the material may be surrounded by an insulator 4). Alternatively, the heating cable may comprise a so-called series resistance heating cable. An example of a series resistance heating cable is shown in FIG. 8, and comprises the material 42 (including NTC and PTC components) surrounded by an insulation jacket or coating 44. A conductive outer braid 46 (e.g. copper braid of approximately 0.5 mm thickness) can optionally be added for additional mechanical protection and/or use as an earth wire. The braid may be covered by a thermoplastic outer jacket 48 for additional mechanical protection. In use the heating cable may be connected at either end to a power source (typically a constant voltage of source). The connection is made to the material 42 such that current flows along the heating cable through the material 42, thereby causing the heating cable to be heated by the current.

The series resistance heating cable need not necessarily include two different PTC components, but may for example include a single PTC component and a single NTC component. Indeed, any number of NTC components and PTC components may be used in the series resistance heating cable (or indeed in a heating cable of the form shown in FIG. 1).

A heating cable using any of the materials described above can be used in any suitable environment in which heating is required. For example, the heating cable may be applied along a pipe which is exposed to fluctuations in temperature, or other fluid conveying apparatus. Alternatively the heating cable may be used for example to heat an environment to be used by people, for example providing under-floor heating. The heating cable may be provided in a car seat in order to heat the seat. The heating cable may be of the type shown in FIG. 1 or of the type shown in FIG. 7.

The invention claimed is:

1. A material comprising:

a first component having a first positive temperature coefficient of resistance characteristic;

a second component having a second positive temperature coefficient of resistance characteristic, the second positive temperature coefficient of resistance characteristic being different from the first positive temperature coefficient of resistance characteristic, the proportions of the first component and the second component being such that the material has a positive temperature coefficient of resistance characteristic which is a combination of the first and second positive temperature coefficient of resistance characteristics of the first and second components; and a third component having a first negative temperature coefficient of resistance characteristic.

2. The material of claim 1, further comprising a fourth component having a second negative temperature coefficient of resistance characteristic, the second negative temperature coefficient of resistance characteristic being different from the first negative temperature coefficient of resistance characteristic.

3. A material comprising:

a first component having a first negative temperature coefficient of resistance characteristic; and a second component having a second negative temperature coefficient of resistance characteristic, the second negative temperature coefficient of resistance characteristic being different from the first negative temperature coefficient of resistance characteristic, the proportions of the two components being such that the material has a negative temperature coefficient of resistance characteristic which is a combination of the first and second negative temperature coefficient of resistance characteristics of the first and second components.

4. The material of claim 3, further comprising a third component having a first positive temperature coefficient of resistance characteristic.

5. The material of claim 4, further comprising a fourth component having a second positive temperature coefficient of resistance characteristic, the second positive temperature coefficient of resistance characteristic being different from the first positive temperature coefficient of resistance characteristic.

6. The material of claim 3, further comprising a heating cable comprising one or more conductors embedded in the material.

7. A method of making a material, the method comprising:

mixing a first component having a first positive temperature coefficient of resistance characteristic into a matrix; and mixing a second component having a second positive temperature coefficient of resistance characteristic into the matrix, the second positive temperature coefficient of resistance characteristic being different from the first positive temperature coefficient of resistance characteristic, the proportions of the two components being selected such that the material has a positive temperature coefficient of resistance characteristic which is a combination of the first and second positive temperature coefficient of resistance characteristics of the first and second components; and mixing a third component having a first negative temperature coefficient of resistance characteristic into the matrix.

8. A method of making a material, the method comprising:

mixing a first component having a first negative temperature coefficient of resistance characteristic into a matrix; and mixing a second component having a second negative temperature coefficient of resistance characteristic into the matrix, the second negative temperature coefficient of resistance characteristic being different from the first negative temperature coefficient of resistance characteristic, the proportions of the two components being selected such that the material has a negative temperature coefficient of resistance characteristic which is a combination of the first and second negative temperature coefficient of resistance characteristics of the first and second components.

9. The method as claimed in claim 8, wherein the matrix comprises a polymer.

10. A heating cable comprising a first conductor which is surrounded by extruded negative temperature coefficient of resistance material, and a second conductor, the first and second conductors being embedded within an extruded positive temperature coefficient of resistance material.

11. A heating cable comprising a first conductor which is surrounded by extruded positive temperature coefficient of resistance material, and a second conductor, the first and second conductors being embedded within an extruded negative temperature coefficient of resistance material.

12. The heating cable of claim 11, wherein the extruded negative temperature coefficient of resistance material comprises a ceramic.

13. The heating cable of claim 12, wherein the ceramic comprises a mixture of $Mn_2O_3$ and NiO.

14. The heating cable of claim 13, wherein the ceramic comprises 82% of $Mn_2O_3$ and 18% of NiO.

15. The heating cable of claim 13, wherein the mixture is calcinated.

16. The heating cable of claim 15, wherein the calcination takes place at a temperature of at least 900° C.

17. The material of claim 1, further comprising a heating cable comprising one or more conductors embedded in the material.

18. The method as claimed in claim 7, wherein the matrix comprises a polymer.

19. The heating cable of claim 10, wherein the extruded negative temperature coefficient of resistance material comprises a ceramic.

* * * * *